US010288236B1

(12) United States Patent
Chen

(10) Patent No.: US 10,288,236 B1
(45) Date of Patent: May 14, 2019

(54) SHAPEABLE LIGHT STRING AND METHODS FOR TREE DECORATION

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 15/911,839

(22) Filed: Mar. 5, 2018

Related U.S. Application Data

(60) Provisional application No. 62/466,646, filed on Mar. 3, 2017, provisional application No. 62/466,547, filed
(Continued)

(51) Int. Cl.

| | |
|---|---|
| ***F21S 4/26*** | (2016.01) |
| ***F21V 23/00*** | (2015.01) |
| ***F21V 33/00*** | (2006.01) |
| ***F21V 19/00*** | (2006.01) |
| ***A47G 33/08*** | (2006.01) |
| ***A47G 33/06*** | (2006.01) |

(Continued)

(52) U.S. Cl.
CPC ..... *F21S 4/26* (2016.01); *A47G 33/06* (2013.01); *A47G 33/08* (2013.01); *F21V 19/0025* (2013.01); *F21V 23/002* (2013.01); *F21V 23/003* (2013.01); *F21V 33/0028* (2013.01); *A47G 2033/0827* (2013.01); *F21W 2121/04* (2013.01); *F21Y 2103/30* (2016.08); *F21Y 2113/13* (2016.08); *F21Y 2115/10* (2016.08)

(58) Field of Classification Search
CPC ..... F21S 4/26; A47G 33/06; A47G 33/08; A47G 2033/0827; F21V 23/002; F21V 33/0028; F21V 19/0025; F21V 23/003; F21Y 2103/30; F21Y 2115/10; F21Y 2113/13; F21W 2121/04
See application file for complete search history.

(56) References Cited

U.S. PATENT DOCUMENTS

| | | | |
|---|---|---|---|
| 2,201,045 | A | 5/1940 | Lundstrom |
| 2,857,506 | A | 10/1958 | Minteer |

(Continued)

FOREIGN PATENT DOCUMENTS

| | | | |
|---|---|---|---|
| CN | 200982547 | Y | 11/2007 |
| CN | 201121811 | Y | 9/2008 |

(Continued)

*Primary Examiner* — Donald L Raleigh
(74) *Attorney, Agent, or Firm* — Christensen, Fonder, Dardi & Herbert PLLC

(57) ABSTRACT

An artificial tree that includes a tree trunk, branches on the tree trunk, a power circuit and a shaped light string. The shaped light string is on the branches, is in electrical connection with the power circuit and includes a pair of parallel wires and a plurality of light emitting diode (LED) assemblies electrically connected to the wires, the LED assemblies oriented to direct a maximum intensity of light in a first direction. The shaped light string defines multiple of lighting sections, that extend from a main portion of the shaped light string and include a first longitudinally-extending portion of the wires, a second longitudinally-extending portion of the wires, the second portion being adjacent to, and in contact with, the first portion, an LED assembly adjacent the first and second portions, and a bend forming an end portion of the lighting section.

32 Claims, 11 Drawing Sheets

Related U.S. Application Data on Mar. 3, 2017, provisional application No. 62/598,288, filed on Dec. 13, 2017.

(51) Int. Cl.

| | |
|---|---|
| *F21Y 115/10* | (2016.01) |
| *F21W 121/04* | (2006.01) |
| *F21Y 113/13* | (2016.01) |
| *F21Y 103/30* | (2016.01) |

(56) References Cited

U.S. PATENT DOCUMENTS

| | | | | |
|---|---|---|---|---|
| 3,603,780 | A | 9/1971 | Lu | |
| 3,617,732 | A | 11/1971 | Fisher | |
| 3,970,834 | A | 7/1976 | Smith | |
| 3,985,924 | A | 10/1976 | Pritza | |
| 4,020,201 | A | 4/1977 | Miller | |
| 4,140,823 | A | 2/1979 | Weskamp | |
| 4,161,768 | A | 7/1979 | Gauthier et al. | |
| 4,761,720 | A | 8/1988 | Solow | |
| 4,812,956 | A | 3/1989 | Chen | |
| 4,870,547 | A | 9/1989 | Crucefix | |
| 4,908,743 | A | 3/1990 | Miller | |
| 5,015,510 | A | 5/1991 | Smith | |
| 5,091,834 | A | 2/1992 | Kao et al. | |
| 5,150,964 | A | 9/1992 | Tsui | |
| 5,609,412 | A * | 3/1997 | Contigiani ..... | F21V 17/007 362/123 |
| 5,776,559 | A | 7/1998 | Woolford | |
| 5,834,901 | A | 11/1998 | Shen | |
| 5,839,819 | A | 11/1998 | Pan | |
| 5,855,705 | A | 1/1999 | Gauthier | |
| 6,042,418 | A | 3/2000 | Cummings | |
| 6,086,221 | A | 7/2000 | Wu | |
| 6,347,965 | B1 | 2/2002 | Pan | |
| 6,354,719 | B1 | 3/2002 | Pan | |
| 6,582,094 | B2 | 6/2003 | Liu | |
| 6,592,238 | B2 | 7/2003 | Cleaver et al. | |
| 6,604,841 | B2 | 8/2003 | Liu | |
| 6,758,001 | B1 | 7/2004 | Su | |
| 6,769,954 | B2 | 8/2004 | Su | |
| 6,883,951 | B2 | 4/2005 | Wu | |
| 6,908,215 | B2 | 6/2005 | Wu | |
| 6,914,194 | B2 | 7/2005 | Fan | |
| 7,052,156 | B2 | 5/2006 | Primeau | |
| 7,088,904 | B2 | 8/2006 | Ryan, Jr. | |
| 7,445,824 | B2 | 11/2008 | Leung et al. | |
| 7,481,555 | B2 | 1/2009 | Huang et al. | |
| 7,554,266 | B1 | 6/2009 | Chen | |
| 7,661,847 | B2 | 2/2010 | Wang | |
| 7,784,961 | B1 * | 8/2010 | Rawlings ..... | F21S 2/00 362/123 |
| D623,084 | S | 9/2010 | Chen et al. | |
| 7,926,978 | B2 | 4/2011 | Tsai | |
| 8,397,381 | B2 | 3/2013 | Tsai | |
| 8,454,186 | B2 | 6/2013 | Chen | |
| 8,454,187 | B2 | 6/2013 | Chen | |
| 8,469,734 | B2 | 6/2013 | Chen | |
| 8,469,750 | B2 | 6/2013 | Chen | |
| 8,562,175 | B2 | 10/2013 | Chen | |
| 8,568,015 | B2 | 10/2013 | Chen | |
| 8,569,960 | B2 | 10/2013 | Chen | |
| 8,592,845 | B2 | 11/2013 | Chen | |
| 8,608,342 | B2 | 12/2013 | Chen | |
| 8,641,229 | B2 | 2/2014 | Li | |
| 8,870,404 | B1 | 10/2014 | Chen | |
| 8,876,321 | B2 | 11/2014 | Chen | |
| 8,974,072 | B2 | 3/2015 | Chen | |
| 9,044,056 | B2 | 6/2015 | Chen | |
| 9,055,777 | B2 | 6/2015 | Chen | |
| 9,066,617 | B2 | 6/2015 | Chen | |
| 9,119,495 | B2 | 9/2015 | Leung et al. | |
| 9,140,438 | B2 | 9/2015 | Chen | |
| 9,157,587 | B2 | 10/2015 | Chen | |
| 9,157,588 | B2 | 10/2015 | Chen | |
| 9,179,793 | B2 | 11/2015 | Chen | |
| 9,220,361 | B1 | 12/2015 | Chen | |
| 9,222,656 | B2 | 12/2015 | Chen | |
| 9,243,788 | B2 | 1/2016 | Chen | |
| 9,291,318 | B1 | 3/2016 | Benson | |
| 9,439,528 | B2 | 9/2016 | Chen | |
| 9,441,800 | B1 | 9/2016 | Chen | |
| 9,441,823 | B1 | 9/2016 | Chen | |
| 9,526,286 | B2 | 12/2016 | Chen | |
| 9,572,446 | B2 | 2/2017 | Chen | |
| 9,593,831 | B2 | 3/2017 | Chen | |
| 9,648,919 | B2 | 5/2017 | Chen | |
| 9,617,074 | B2 | 6/2017 | Chen | |
| 9,671,097 | B2 | 6/2017 | Chen | |
| 9,677,748 | B1 | 6/2017 | Chen | |
| 9,677,749 | B2 | 6/2017 | Chen | |
| 9,883,566 | B1 * | 1/2018 | Chen ..... | H05B 37/0272 |
| 2002/0097573 | A1 | 7/2002 | Shen | |
| 2003/0063463 | A1 | 4/2003 | Sloan et al. | |
| 2004/0012950 | A1 | 1/2004 | Pan | |
| 2004/0080281 | A1 | 4/2004 | Pan | |
| 2004/0090770 | A1 | 5/2004 | Primeau | |
| 2004/0096596 | A1 | 5/2004 | Palmer, III et al. | |
| 2004/0246718 | A1 | 12/2004 | Fan | |
| 2005/0047136 | A1 | 3/2005 | Fan | |
| 2005/0249892 | A1 | 11/2005 | Rocheleau | |
| 2006/0158878 | A1 | 7/2006 | Howell | |
| 2006/0221609 | A1 | 10/2006 | Ryan, Jr. | |
| 2007/0015396 | A1 | 1/2007 | Mrakovich et al. | |
| 2007/0177402 | A1 | 8/2007 | Wu | |
| 2007/0230174 | A1 | 10/2007 | Hicks et al. | |
| 2008/0049424 | A1 | 2/2008 | Wang | |
| 2008/0094828 | A1 | 4/2008 | Shao | |
| 2008/0218092 | A1 | 9/2008 | Chang et al. | |
| 2010/0001664 | A1 | 1/2010 | Shih | |
| 2010/0072747 | A1 | 3/2010 | Krize | |
| 2011/0062875 | A1 | 3/2011 | Altamura | |
| 2011/0228535 | A1 | 9/2011 | Shao | |
| 2013/0078847 | A1 * | 3/2013 | Chen ..... | F21V 19/0025 439/404 |
| 2013/0107514 | A1 | 5/2013 | McNabb et al. | |
| 2013/0301246 | A1 * | 11/2013 | Chen ..... | A41G 1/005 362/123 |
| 2014/0087094 | A1 | 3/2014 | Leung et al. | |
| 2014/0334134 | A1 | 11/2014 | Loomis | |
| 2015/0029703 | A1 | 1/2015 | Chen | |
| 2015/0078000 | A1 * | 3/2015 | Chen ..... | F21S 4/002 362/249.16 |
| 2015/0157159 | A1 | 6/2015 | Leung et al. | |
| 2016/0341408 | A1 | 11/2016 | Altamura | |
| 2017/0328527 | A1 | 11/2017 | Yang et al. | |

FOREIGN PATENT DOCUMENTS

| | | |
|---|---|---|
| CN | 201897194 U | 7/2011 |
| CN | 201898147 U | 7/2011 |
| CN | 201966240 U | 9/2011 |
| CN | 202613183 U | 12/2012 |
| CN | 203703878 U | 7/2014 |
| DE | 8436328 | 4/1985 |
| GB | 2 454 546 A | 5/2009 |

* cited by examiner

SHAPEABLE LIGHT STRING AND METHODS FOR TREE DECORATION

RELATED APPLICATIONS

This application claims the benefit of U.S. Provisional Patent Application No. 62/466,646, filed Mar. 3, 2017, of U.S. Provisional Patent Application No. 62/466,547, filed Mar. 3, 2017, and of U.S. Provisional Patent Application No. 62/598,288, filed Dec. 13, 2017, the disclosures of which are incorporated by reference herein in their entireties.

FIELD OF THE DISCLOSURE

The present disclosure relates to shapeable light strings. More specifically, the present disclosure relates to shapeable light strings, pre-lit artificial trees or other decorative structure with light-emitting-diode-based lighting and wiring systems, including LED-based lighting and wiring systems.

BACKGROUND

Traditional lighted artificial trees, decorative sculptures, or other pre-lit artificial decorations typically include components that are mechanically affixed to each other to represent a tree, figurine, or other object, such as a pine tree, reindeer, or snowman. Light strings are attached to the pre-lit artificial decorations for illumination and decorative purposes. Traditional light strings typically include a set of insulated wires and incandescent bulbs. The insulated wires typically comprise a pair of insulated multi-strand conductors, for example, a pair of 22 AWG insulated wires, each multi-strand conductor having sixteen twisted copper strands, connected to each bulb. The gauge of the wire must be sufficient to withstand the rigors of shipping, handling, and storage, as well as the extremes of outdoor weather, such as snow, rain, and a substantially wide range of temperatures.

More recently, and in an effort to increase energy efficiency and reliability, manufacturers have begun using light-emitting diodes (LEDs) rather than incandescent bulbs. Indeed, lighted artificial decorations having light strings with LEDs rather than incandescent bulbs are well known. Such known lighted decorations often simply replace the incandescent bulbs with similar bulb or lamp assemblies that use LED "bulbs," utilizing the same insulated, multi-strand conductor wiring as the incandescent-bulb-based light strings, and utilizing the same techniques of affixing the light strings to the sculpture. In some cases, the lower current requirements of the LEDs may allow the use of smaller diameter conductors or fewer conductor strands, for example, allowing the use of 25 AWG wire, for example, instead of 22 AWG wire. While such a technique maintains the look and feel of a traditional lighted decorations having traditional light strings, the growing popularity of more and more lights on a pre-lit artificial decoration, even with LED technology, typically requires an enormous length of insulated wire that remains visible on the components of the artificial decoration, thereby diminishing its perceived attractiveness.

Further improvements to LED lighting and to techniques for maintaining the perceived attractiveness of pre-lit artificial structures or objects would be welcome.

SUMMARY

According to various embodiments of the disclosure, a shaped LED light string and a method of decoration is disclosed for a pre-lit artificial structure, such as an artificial tree, figure, or other decorative object.

One or more embodiments of the disclosure provide benefits in the form of an LED light string that is shaped for distribution in an artificial tree or other decorative structure or sculpture, such as for example, during manufacture of a pre-lit artificial tree, or an outdoor wire-framed sculpture such as a deer, Santa Claus, and so on. In various embodiments, the shaped form of the LED light strings allows the direction of light emitted from individual LEDs in the light string to be readily controlled for improving the overall appearance of the pre-lit artificial decoration. For example, various embodiments of the disclosure allow for pre-lit artificial decorations to include LED light strings with a more uniform appearance with regard to the light emitted from LEDs on the light string.

For example, referring to FIG. 1, an LED light string 50 is depicted distributed among branches 54 of an artificial tree 55. While individual LEDs 58 of the light string 50 are distributed among the branches 54, the light emitted from each LED 58 is pointed in various directions 62. This results because as the light string 50 is strung along and attached to the various branches 54 the orientation of the LEDs 58, and thereby the direction of light emitted from each of the LEDs 58 is uncontrolled. As such, the brightness of the LEDs 58 will appear inconsistent, negatively impacting the appearance of the tree or other similarly configured pre-lit decoration. While the embodiment of the invention as depicted in FIG. 1 may represent an improvement over known light strings, the shapeable or directable light strings, systems, trees and so on described below and depicted in FIGS. 2-9B represent a further improvement.

As such, one or more embodiments of the disclosure are directed to a shaped LED light string to define a plurality of individual light sections of the LED light string that allow for individual directional control of the LEDs. Accordingly, embodiments of the disclosure are directed to a shaped LED light string including a pair of parallel wires and an electrically insulative material disposed over the pair of parallel wires to define a plurality of insulated sections. In various embodiments, each of the plurality of insulated sections are separated from one another by a plurality of gaps positioned between ends of one or more adjacent insulated sections, where each of the plurality of gaps expose portions of the pair of parallel wires.

In one or more embodiments the light string includes a plurality of LEDs electrically bridging the pair of parallel wires, the LEDs being disposed in the plurality of gaps between ends of each of the insulated sections. In various embodiments, the LEDs are oriented to direct a maximum intensity of light emitted from the LEDs in a direction substantially parallel to a longitudinal axis that is parallel to the pair of parallel wires. In one or more embodiments, the light string includes a translucent material disposed in each of the plurality of gaps and encapsulating each of the plurality of LEDs and the exposed portions of the pair of parallel wires.

In various embodiments, the light string is shaped to define a plurality of lighting sections, each of the plurality of lighting sections extending between portions of adjacent insulated sections and including an LED of the plurality of LEDs and the translucent material disposed in a gap of the plurality of gaps, each of the lighting sections including a bend in one of the portions of the adjacent insulation sections such that the portions are at least partially folded together to define a first end portion of the lighting section including the LED, the translucent material, and the bend.

One or more embodiments of the disclosure are directed to a method of shaping an LED light string for decoration. In various embodiments, the method includes obtaining a light string and forming, using the light string, a plurality of lighting sections. In various embodiments, each of the plurality of lighting sections extending between portions of adjacent insulated sections of the light string and include an LED and translucent material disposed between the adjacent insulated sections. In one or more embodiments, each of the lighting sections are formed via a bend in one of the portions of the adjacent insulation sections such that the portions are at least partially folded together to define a first end portion of the lighting section including the LED, the translucent material, and the bend.

One or more embodiments are directed to a lighted artificial tree including a tree trunk having a central axis and a plurality of branches extending radially outwardly from the tree trunk and the central axis, and a plurality of shaped LED light strings. In various embodiments, each of the plurality of shaped LED light strings in electrical connection with a main power circuit disposed at least partially within the tree trunk for transmitting electrical power to the plurality of shaped LED light strings. In various embodiments, each of the plurality of shaped LED light strings are shaped to define a plurality of lighting sections, each of the plurality of lighting sections extending between portions of adjacent insulated sections and including an LED and a translucent material disposed in a gap between each adjacent insulated section. In one or more embodiments, each of the lighting sections include a bend in one of the portions of the adjacent insulation sections such that the portions are at least partially folded together to define a first end portion of the lighting section including the LED, the translucent material, and the bend. In various embodiments wherein the plurality of lighting sections are distributed about the plurality of branches.

One or more embodiments are directed to a lighted decorative structure including a main structure body having a central axis and a plurality of shaped LED light strings. In various embodiments each of the plurality of shaped LED light strings are in electrical connection with a main power circuit disposed at least partially within the main structure body for transmitting electrical power to the plurality of light strings. In various embodiments, each of the plurality of shaped LED light strings are shaped to define a plurality of lighting sections, each of the plurality of lighting sections extending between portions of adjacent insulated sections and including an LED and a translucent material disposed in a gap between each adjacent insulated section. In one or more embodiments, each of the lighting sections include a bend in one of the portions of the adjacent insulation sections such that the portions are at least partially folded together to define a first end portion of the lighting section including the LED, the translucent material, and the bend. In various embodiments wherein the plurality of lighting sections are distributed about the main structure body.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
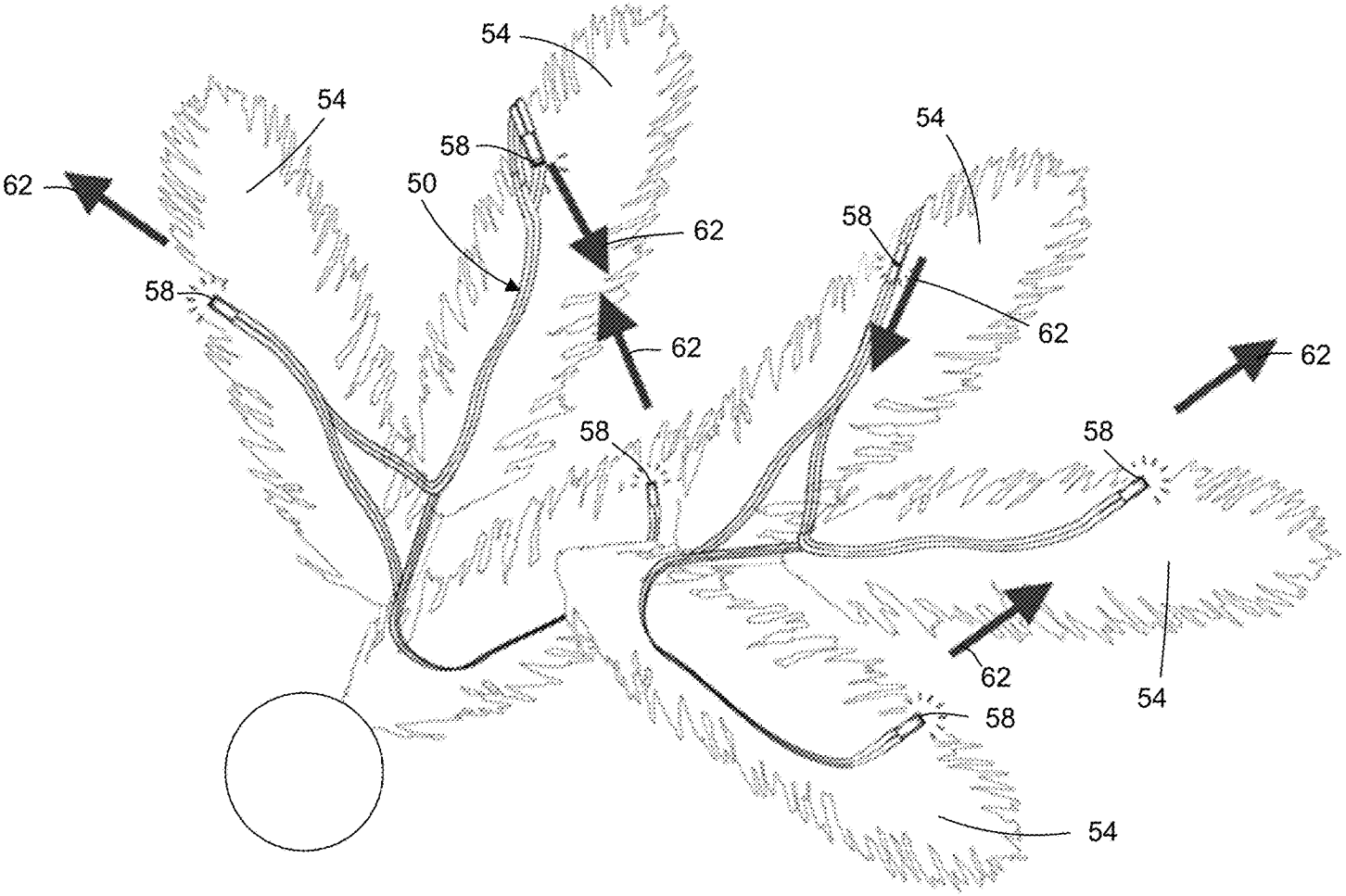
FIG. 1 depicts an LED light string distributed among branches of an artificial tree.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 2:
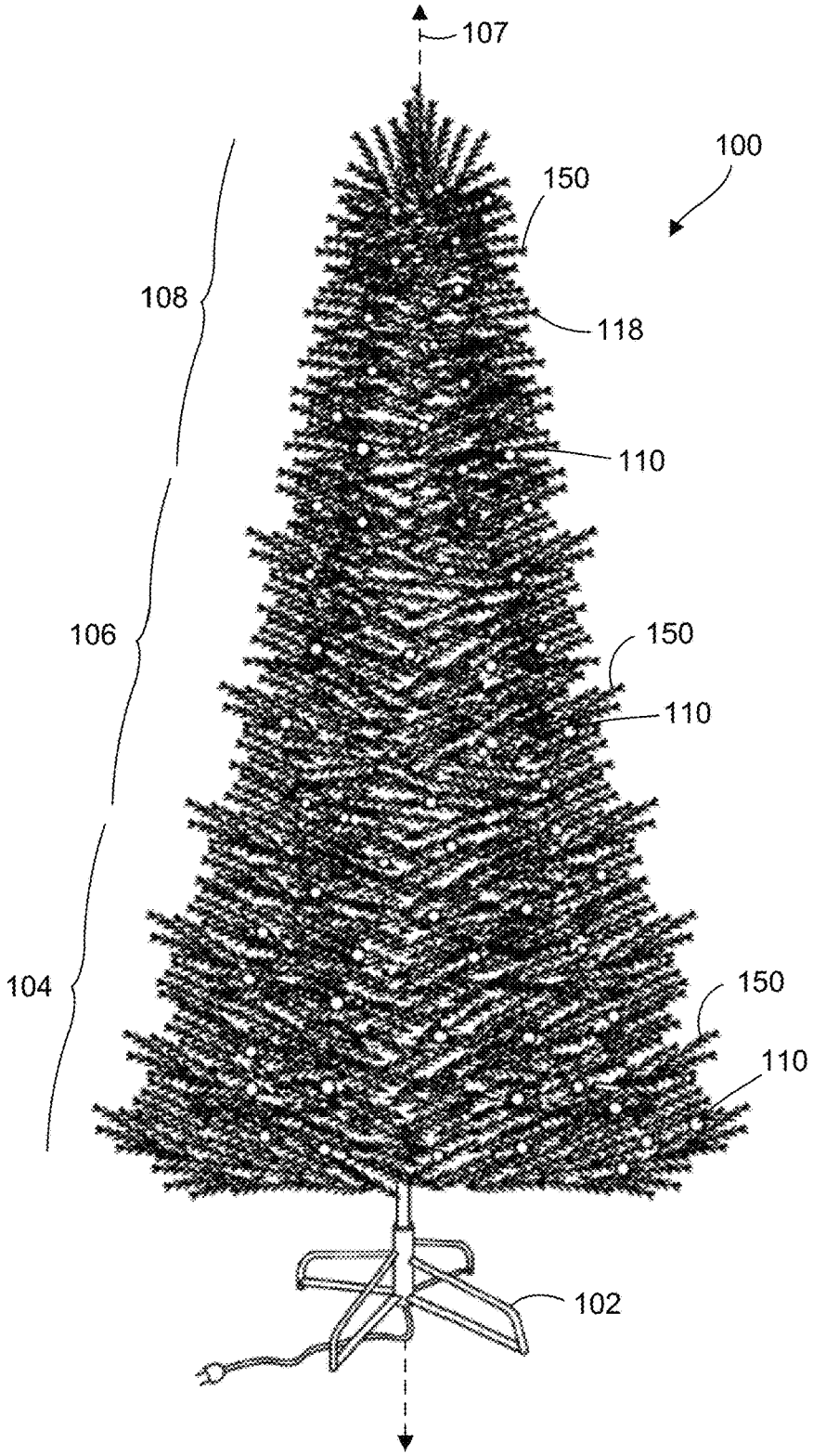
FIG. 2 depicts a lighted artificial tree with a light-emitting-diode-based lighting system, according to one or more embodiments of the disclosure.

Referring to FIG. 2, an embodiment of a lighted artificial tree 100 with a light-emitting-diode-based lighting system is depicted. In the depicted embodiment, tree 100 includes tree stand 102 and three tree sections, first tree section 104, second tree section 106 and third tree section 108. As depicted, tree section 104 fits into tree stand 102, tree section 106 couples to tree section 104, and tree section 108 couples to tree section 106 along a central vertical axis 107. It will be understood that tree 100 may include more or fewer than three tree sections. For example, in some embodiments, tree 100 includes a single tree section; in other embodiments, two tree sections or four tree sections, or in some embodiments, more than four tree sections. Generally, a relatively tall tree will include more tree sections as compared to a relatively short tree section. Each tree section includes a plurality of light-emitting-diodes (LEDs) 110, as will be described further below.

Figure 4:
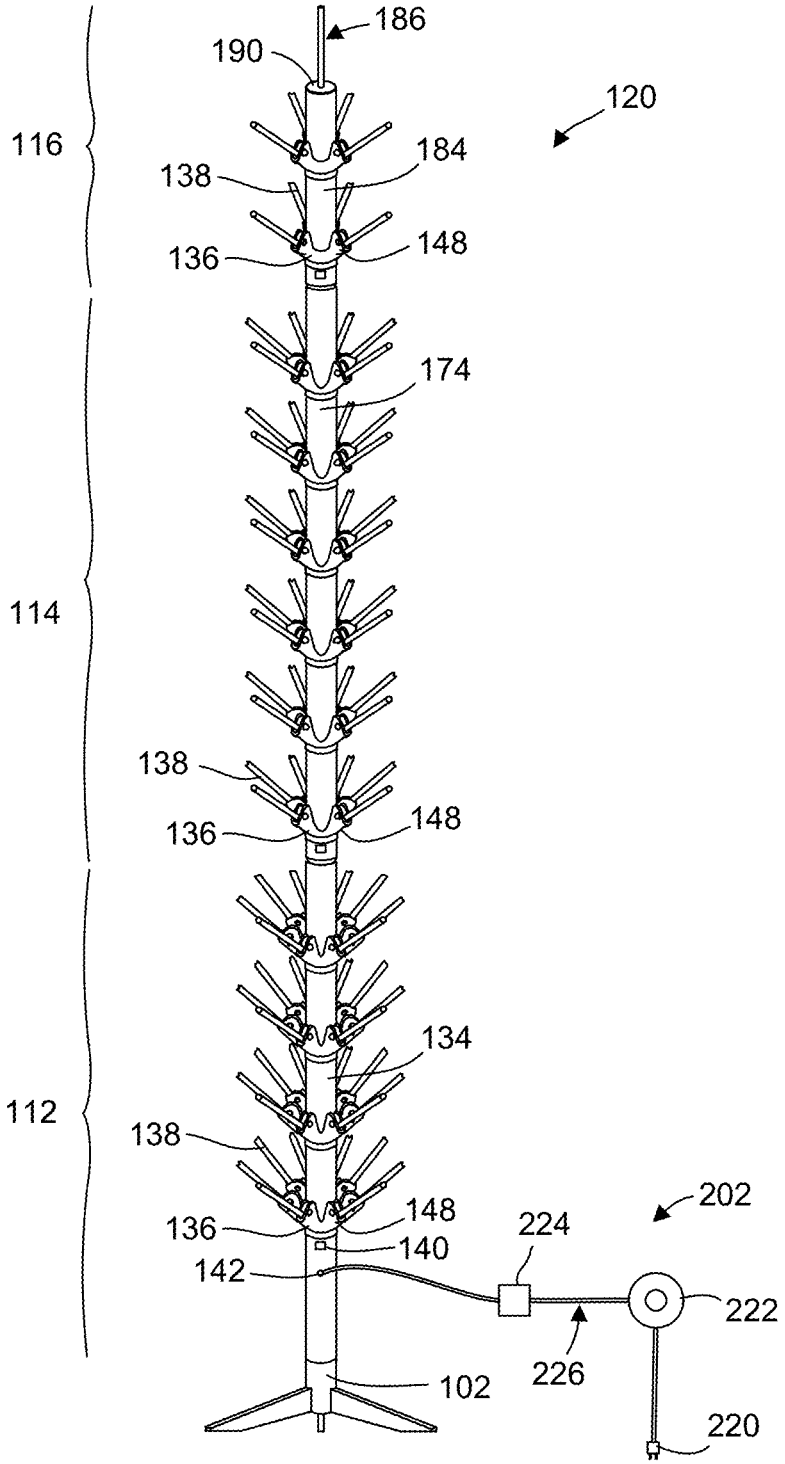
FIG. 4 depicts an assembled view of a tree frame for an artificial tree, according to one or more embodiments of the disclosure.
Figure 5:
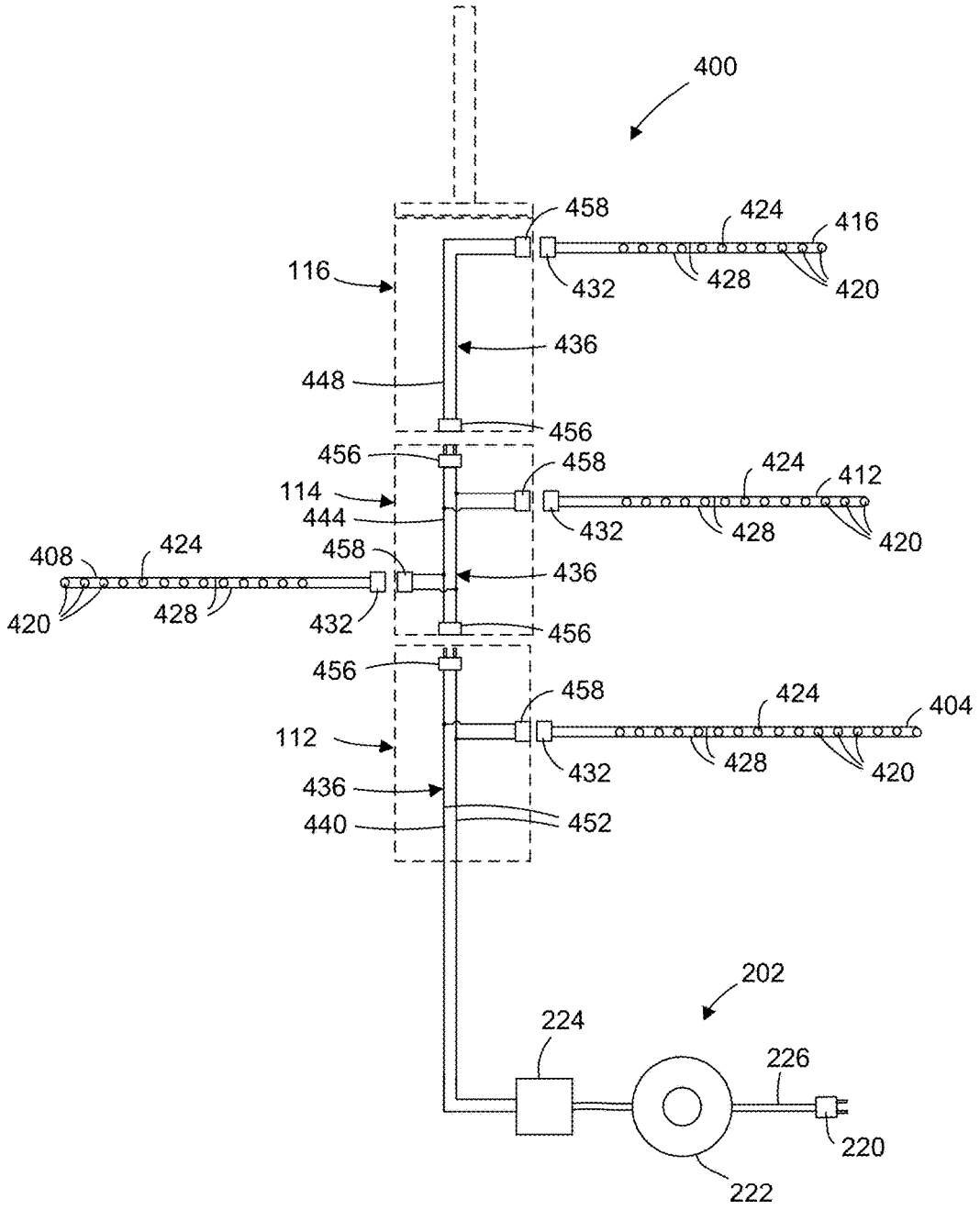
FIG. 5 depicts a block diagram of a tree lighting system, according to one or more embodiments of the disclosure.

In one or more embodiments, each tree section, including tree sections 104, 106, and 108, include a tree frame section 112, 114, and 116, respectively (FIGS. 3-4), a plurality of artificial leaves or artificial tree needles 118 (FIG. 2), and an LED-based lighting subsystem (FIG. 5).

Figure 3:
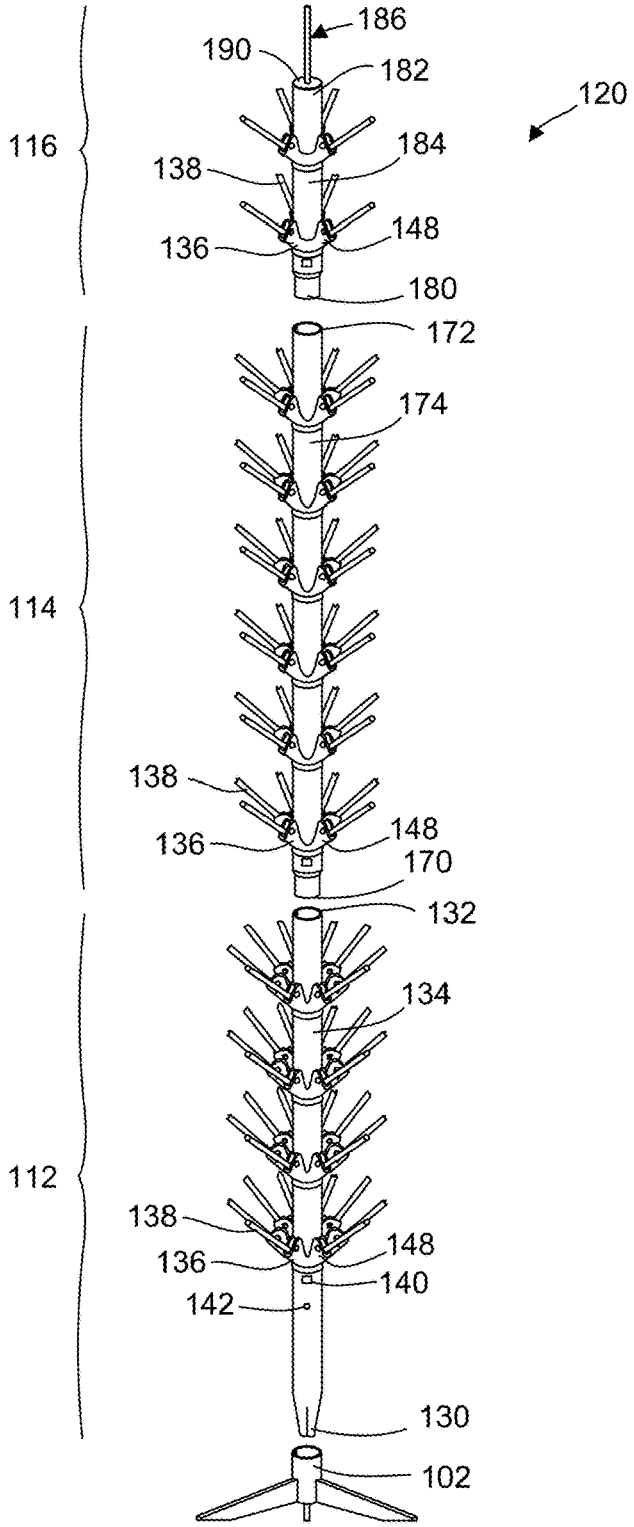
FIG. 3 depicts a partially exploded view of a tree frame for an artificial tree, according to one or more embodiments of the disclosure.

Referring to FIGS. 3 and 4, a partially exploded view of tree frame 120 is depicted (FIG. 3), and an assembled view of tree frame 120 is depicted (FIG. 4). Tree frame 120 comprises first tree frame section 112, second tree frame section 114 and third tree frame section 116.

First tree frame section 112 includes first end 130, second end 132, first trunk portion 134, a plurality of branch support portions 136, and a plurality of branch portions 138. First tree frame section 112 may comprise a bottom section of tree frame 120.

First trunk portion 134, in an embodiment, and as depicted, comprises a hollow, cylindrical structure defined by a trunk wall. In an embodiment, trunk portion 134 comprises a metal material, though other materials may be utilized, including plastic. First end 130 may be narrower than other portions of trunk portion 134 and be configured to be inserted into tree stand 102. Second end 132 defines an open end configured to receive an end of second tree frame section 114. In an embodiment, trunk portion 134 defines one or more trunk apertures 140 for receiving a portion of a lighting subsystem. First trunk portion 134 may also define trunk power-cord aperture 142 for receiving a power cord.

In an embodiment, and as depicted, first tree frame section 112 includes four branch support portions 136, each branch support portion 136 including eight branch-support arms 148. In an embodiment, branch support portions 136 comprise a metal material and are welded to trunk portion 134 to affix them to the trunk. First tree frame section 112 may include more or fewer than four branch support portions 136, depending on first trunk portion 134 length (a longer length generally having more portions 136), and depending on desired branch density (more portions 136 generally meaning higher branch density). Each branch support portion 136 may have more or fewer than eight branch support arms 148. A relatively higher number of branch support arms 148 not only increases branch density (number of branches at one vertical level), but also facilitates the use of more and longer branches on a lower tree section, i.e., tree section 104.

As described further below, in various embodiments branch support portions 136 of tree sections 106 and 108 (and tree frame sections 114 and 116) may include fewer branch arms 148 per branch support portion 136, as compared to tree section 104.

Branch portions 138 may generally comprise a linear rod as depicted, and may comprise a metal material. However, in other embodiments, branch portions 138 may comprise other shapes and materials as desired to resemble a branch of a real tree. An attached end of each branch portion 138 is received by a receiving slot such that each branch portion 138 is supported by a branch support arm 148. As will be understood by those of skill in the art, the attached end of a branch portion 138 may comprise a circular shape, or otherwise define an aperture. A pin, or other fastener, not show, may be inserted through such an aperture, and through the apertures of branch support arms 148 to secure the branch portion 138 to the branch support arm in a manner that allows pivoting of the branch portion 138 with respect to the fixed branch support arm 148.

Referring specifically to FIG. 2, a plurality of artificial leaves or needles or sub-branches 118 with needles may be attached to branch portions 138 to form completely assembled branches 160.

Second tree frame section 114 is substantially similar to tree frame section 112, and includes first end 170, second end 172, trunk portion 174, a plurality of branch support portions 136 and a plurality of branch portions 138. Second tree frame section 114 may comprise a middle section of tree frame 120, First end 170 may be tapered, or have a smaller diameter as compared to other portions of trunk portion 174, and is configured to insert into second end 132 of first tree frame section 112.

In certain embodiments, first and second tree frame sections 112 and 114 may be coupled by other means, such as by a sleeve structure. As depicted, trunk portion 174 may be coupled to trunk portion 134 in any rotational alignment as no keying structure is provided. In other embodiments, keying structure may be provided at trunk portion ends such that the trunk portions must be rotationally aligned to a single rotational alignment, or one of multiple rotational alignments, relative to one another so as to be joined.

Second tree frame section 114 is depicted as having a longer trunk portion 174 as compared to trunk portion 134, and therefore includes more branch support portions 136; in this embodiment, second tree frame section 114 includes six branch support portions 136. However, the number of branch support portions 136 may be greater or fewer than six. Trunk portion 174 may have a length that is substantially the same as, or less than trunk portion 134, depending on many factors, including ease of manufacturing, desired tree section weight, packaging, and so on. As with the other tree frame sections, branch support portions 136 may be evenly distributed along the length of the trunk portion. In other embodiments, second trunk portion 174 may be longer or shorter than depicted.

Further, branch support portions 136, as described above, may include fewer branch support arms 148 as compared to branch support portions 136 of first tree frame section 112. As depicted, branch support portions 136 of second tree frame section 114 each include six branch support arms 148 (and hence six branch supports 148 and branches 150). In other embodiments, branch support portions 136 of second tree frame section 114 may include the same number of branch support arms as first tree frame section 112.

Third tree frame section 116, which corresponds to third tree section 108, and which may comprise a top section of tree frame 120, includes trunk portion 184 with first end 180 and second end 182, and a plurality of branch support portions 136 with a plurality of branch support arms 148 supporting multiple branch portions 138. Third tree frame section 116 may also include trunk extension portion 186 having extension 188 and connector 190.

Branch support portions 136 of third tree frame section 116 may comprise fewer branch support arms 148 as compared to branch support portions 136 of second and/or first tree frame sections 114 and 112. In an embodiment, branch support portions 136 of third tree frame section 116 may comprise four branch support arms 148 and fours branch portions 138, each. In other embodiments, branch support portions 136 include more or fewer branch support arms 148.

In embodiments including trunk extension 186, connector 190 is connected to third trunk portion 184. Connector 190 may be inserted fully or partially into an open end of third trunk portion 184. In an embodiment, connector 190 includes a portion fitting into third trunk portion 184, and a portion remaining outside portion 184. In one such embodiment, the portion remaining outside may have a diameter that is larger than the diameter inside portion 184. In an alternate embodiment, connector 190 may fit over end 182 of trunk portion 184.

Extension 188 may comprise a rod or mast or more generally, a substantially straight or linear projecting structure affixed to connector 190. In an embodiment, artificial leaves or needles 118 are affixed directly to extension 188 to form the very top of tree 100.

As described above, tree frame 120 may comprise a variety of structural configurations, with variations on trunk portion length, number of branch support portions 136, number of branch portions 138 per branch support portion 136, branch portion length, and so on.

Referring also to FIG. 4, an assembled tree frame 120 is depicted. As described above with respect to FIG. 3, first tree frame 112 is configured to be inserted into tree stand 102; second tree frame 114 is configured to be inserted into first tree frame 112, and third tree frame 116 is configured to be inserted into second tree frame 114, to form an assembled tree frame 120. Also depicted in FIG. 3 is an input portion 202 of tree lighting system 200, including power plug 220, optional switch 222, and optional controller 224.

Referring to FIG. 5, a schematic of the lighting system 400 is depicted in an embodiment of the disclosure. For the sake of illustration, tree frame sections 112, 114, 116 of respective tree sections 104-108 (FIG. 1) are depicted in dashed lines to suggest the relative placement of portions of the lighting system 400.

Generally, the lighting system 400 transmits electrical power from an external power source to light strings 404-416 and lights 420. Transmission of power to light strings 404-416 may be selective in that power to light strings 404-416 or lights 420 is selectively turned on and off, including for basic on/off functions as well as more sophisticated control functions, such as twinkling, color-changing, flashing, and so on. The lighting system 400 may also transmit communication signals to portions of the artificial tree 100, including to light strings 404-416. In various embodiments, the lights 420 comprise LEDs 424. The LEDs 424 may comprise an assembly with an LED chip having a diode.

In some embodiments, the LEDs 424 may comprise multiple LEDs, such as a red-green-blue (RGB) LED chip. In some assemblies, one or more LEDs 424 may comprise a "twinkling" LED, wherein an LED assembly includes electronics causing the LED 424 to periodically turn on and off. In one or more embodiments, one or more of the light strings 404-416 include all non-twinkling LEDs; in another embodiment, one or more of the light strings 404-416 include one or more twinkling LEDs. For example, in one such embodiment, the artificial tree 100 includes twinkling LEDs that comprise less than 10% or less than 5% twinkling LEDs, depending on the desired effect. Twinkling LEDs may be employed without a central control device.

In an embodiment an LED assembly 424 includes multiple LED chips, rather than having different colors, such as red, green, and blue, LED assembly 424 may include multiple LED chips that are the same color. In one such embodiment, all LED chips are powered at the same time, thus increasing the overall brightness of the LED assembly 424, as compared to a single-chip LED assembly 424. In an embodiment, the number of LED chips is two or more. In one such embodiment, the number of LED chips ranges from two to six; in an embodiment, the number of LED chips is two or four. In other embodiments, only one or fewer than all LED chips of the LED assembly 424 may be powered at the same time. In such a manner, the overall brightness of LED assembly 424 may be controllable. Control may be accomplished by controller 224, or by a controller, such as an integrated-circuit chip, that is integrated into LED assembly 424 and controls only the LED chips of LED assembly 424.

As described above, an input power portion 202 includes power plug 220, optional switch 222, optional controller 224 and input power wiring 226. The power plug 220 is configured to be connected to an external source of power, which may comprise a 120V alternating-current (AC) power source. Optional switch 222 may comprise a switch configured to selectively allow power or communication signals to be transmitted through tree lighting system 200. Optional controller 224 may comprise a controller, microprocessor or other control device for controlling power and/or communication signals. In an embodiment, switch 222 and controller 224 may be combined. In some embodiments, the lighting system 140 may also include power-conditioning circuitry, such as an electrical transformer or other such known electrical componentry for lowering or converting input voltage.

In various embodiments, such power-conditioning circuitry includes an AC-DC (direct current) circuit, which may include a transformer. In another embodiment, such power-conditioning circuitry includes and AC-AC circuit for lowering incoming AC voltage to a voltage appropriate for the electronics, including light strings 404-416 of the tree 100. In some embodiments, such power-conditioning circuitry may be integrated into power plug 220, or may be included with switch 222 and/or controller 224, or may be located elsewhere on, in or about the tree 100.

Input wiring 226 comprises at least two insulated conductors. Each conductor may comprises a plurality of conductor strands, as is known and understood by those of ordinary skill. Herein, "conductor" is mean to include conductors that may comprise a plurality of conductor strands, or a single conductor strand, unless specifically indicated to the contrary. Input wiring 226 may include any or all wiring connecting power plug 220 to the tree 100, including wires external thereto. In some embodiments, the wires 148 of the main power circuit 142 include insulated conductors, and are electrically connected to the power plug 220 and the connectors 172.

In various embodiments, the number of lights 420 or LEDs 424 per light string 404-416 varies. Generally, for tree frame sections 112-116 of tree 100 of relatively large size, for example, tree frame section 112 being the base of the tree 100, the light string 404 may be generally longer, and include more lights 420; for tree frame sections 112-116 of the tree 100 of relatively smaller size, such as detachable section 116, may have a shorter length with fewer lights 420.

As will be described further below, in various embodiments, each light string 404-416 includes a plurality of lights 420 or LEDs 424, parallel wires 428, and a light string connector portion 432. In an embodiment, and as depicted, LEDs 424 may be electrically connected in parallel to one another. In an embodiment, groups of parallel-connected LEDs 424 may be connected to each other in series to form series-parallel or parallel-series connected light string or a series-parallel or parallel-series connected set of lights. The light-set connector portion 432 may form a distinct connector. Each light string connector portion 432 is configured to couple to a respective one of the connectors 432 to mechanically and electrically connect a light string 404-416 to a main power circuit 436 of the lighting system 400. In an embodiment, each of parallel wires 428 comprise a single-strand conductor. In other embodiments, the parallel wires 428 include multi-strand conductors.

In various embodiments, the tree lighting system 400 includes the several trunk power subsystems particular to each tree and tree frame section. More specifically, in certain embodiments, lighting system 400 includes a first trunk power subsystem 440, second trunk power subsystem 444 and third trunk power subsystem 448. In various embodiments, first trunk power subsystem 440 includes wires 452, first trunk electrical connector 456 and lighting connector 458. In an embodiment, first trunk power subsystem 440 includes only a single lighting connector 458. However, in other embodiments, subsystem 440 may include two or more lighting connectors 458 distributed about trunk portion 134, e.g., distributed around the trunk circumference at a common "height" and/or distributed vertically along the length of trunk portion 134. In a further embodiment, subsystem 440 may include one lighting connector 458 per branch and one light string, e.g., light string 404 per branch. In one such configuration, having only one light string per branch, a light string can be distributed on a single branch, thereby avoiding extending light strings from branch to branch. When a light string 404 is a small gauge, thin wire, this can prevent wire breakage or light string damage that might otherwise occur when branches are pivoted by a user.

In an embodiment of a tree having one light string per branch, all LEDs of each light string are electrically connected to one another in parallel, and multiple light strings are connected to one another in series. In one such embodiment, all light strings at a particular branch support portion 136 are electrically connected to one another in series. In another embodiment, only some light strings at a particular branch support portion 136 are electrically connected to each other in series, e.g., each three of six light strings at a tree height/branch support portion 136 are electrically connected to each other in series.

Trunk electrical connector 456 may be located wholly or partially within an interior of tree section 112. Trunk electrical connector 456 is in electrical connection with wires 452, and are configured to connect to a corresponding trunk electrical connector of second tree section 106, thereby transmitting electrical power and in some embodiments, communication data or signals, from tree section 104 to tree section 106, and from tree frame section 112 to tree frame 114.

Embodiments of trunk electrical connectors described herein, are disclosed in U.S. Pat. No. 8,454,186 to Chen, entitled "Modular Lighted Tree with Trunk Electrical Connectors", US Patent Pub. No. 2013/0308301 to Chen, entitled "Modular Tree with Locking Trunk and Locking Electrical Connectors", U.S. Pat. No. 9,044,056 to Chen, entitled "Modular Tree with Electrical Connector", U.S. Pat. No. 9,179,793 to Chen, entitled "Modular Tree with Rotation-Lock Electrical Connectors", US Patent Pub. No. 2014/0287618, entitled Modular Tree with Locking Trunk and Locking Electrical Connectors", U.S. Pat. Pub. No. US 2014/0268689 to Chen, entitled "Modular Tree with Trunk Connectors", all of which are incorporated herein by reference in their entireties.

Lighting connector 458, in an embodiment, is electrically connected to wires 452. In an embodiment, lighting connector 458 includes a pair of electrical terminals, such as electrical terminals, and is configured to mechanically and electrically connect to a connector of first tree section wiring portion 440.

In various embodiments, second trunk portion subsystem 444 and third trunk portion subsystem 448 are substantially similar to first trunk power subsystem 440. However in various embodiments, second and third trunk wiring systems 444, 448 may include additional, fewer, or the same number of lighting connectors 458 and/or trunk electrical connectors 456. Additional discussion of trunk wiring systems or other decorative wiring systems are described in Provisional Application No. 62/441,900 to Chen, entitled "Decorative Sculptures with LED-Based Lighting Systems"; and 62/377,848 to Chen, entitled "Artificial Tree with LED-Based Lighting Systems", each of which are hereby incorporated herein by reference in their entireties.

Figure 6A:
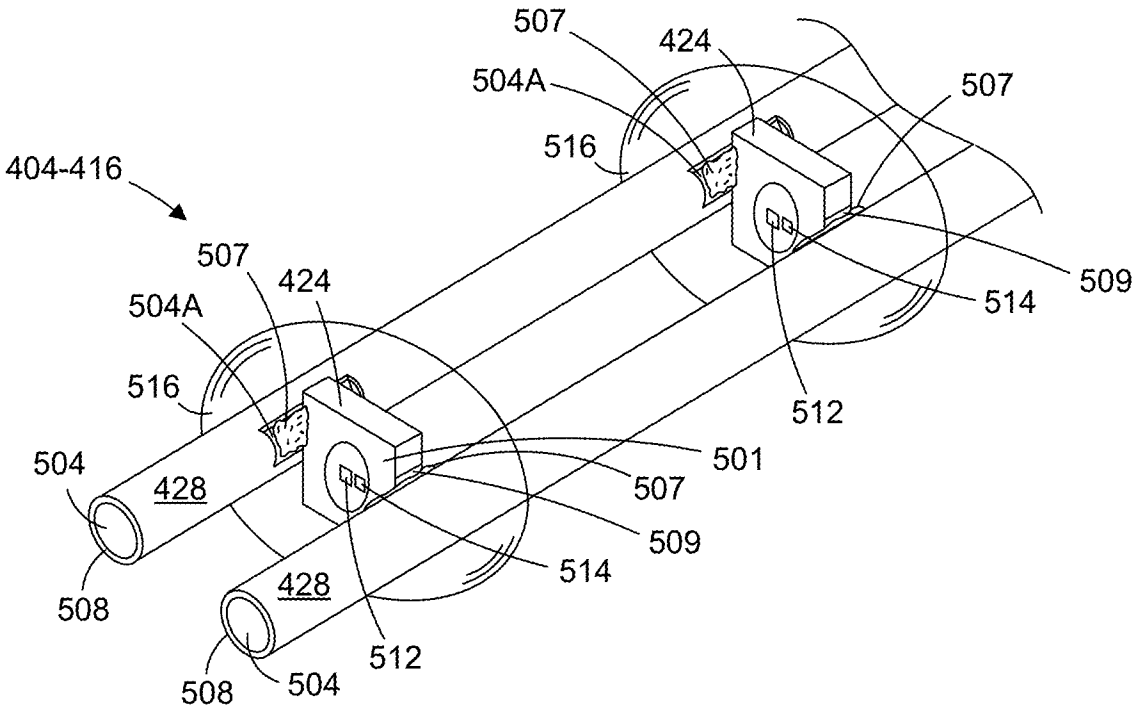
FIGS. 6A-6C depict views of a light string, according to one or more embodiments of the disclosure.
Figure 6C:
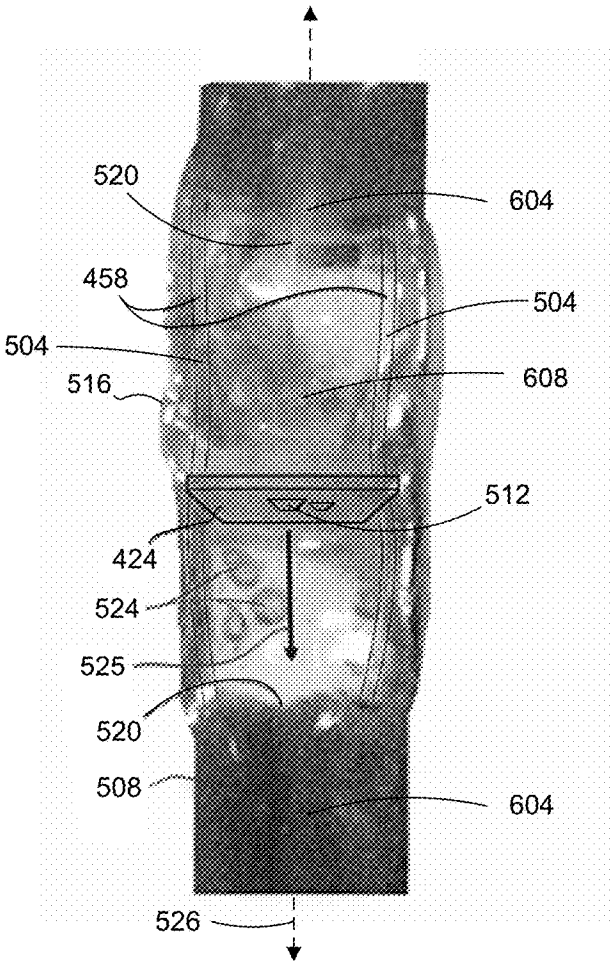
Figure 6B:
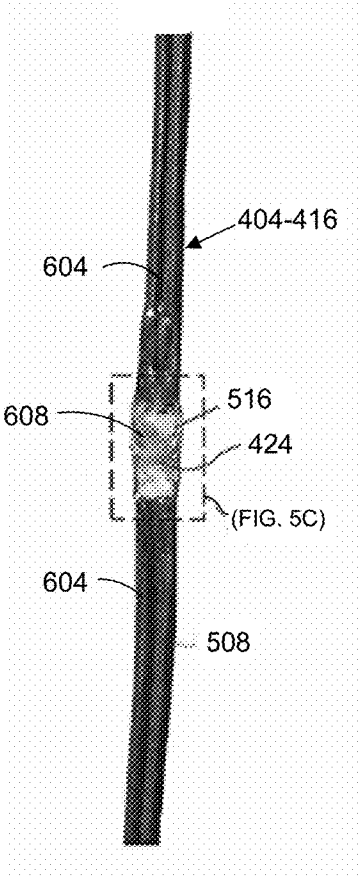

Referring to FIGS. 6A-6C, a portion of the light strings 404-416 (FIG. 4) is depicted. In this embodiment, each of the parallel wires 428 include a single-strand conductor 504 coated with an electrically insulative material 508. In an embodiment, wires 428 are each continuous wires, with continuous conductors 504 extending from one end to another end of the light strings 404-416, connecting each of LEDs 424 in parallel. In various embodiments, LED assemblies ("LEDs") 424 each include an LED chip 512, which may be a surface-mount LED chip mounted on a substrate or base 501 as depicted. In certain embodiments, the LEDs 424 include additional chips such as a controller chip 514 for lighting control of the LED chip 512 and for various twinkling, flashing or other lighting effects as described above. LED chip 512 is electrically connected to conductors 504, such as by electrical contacts 509 on substrate 501 extending between conductors 504 and LED chips 512, and chips 514, when present. In an embodiment, only a portion of insulative wire material is removed from the wire to expose a portion 504*a* of each conductor 504, and solder or conductive paste is used to electrically connect leads or contacts 509 to conductors 504 at exposed conductor portions 504*a*. In various embodiments, a layer of epoxy or other translucent, transmissive or similar material 516 covers or encapsulates each LED 424, forming a protective layer around each LED chip 512 and its connections to conductors 504. Described further below, in various embodiments, the translucent material 516 also forms a lens for light that is emitted from the LED 424. In one or more embodiments, the parallel wires 458 are of a gauge that is in a range of 24 AWG to 30 AWG. In certain embodiments the pair of parallel wires 458 are multi-strand wires.

Referring to FIGS. 6B-6C, in various embodiments, the insulative material 508 defines a plurality of insulated sections 604 along the longitudinal axis 526 of the light string 404-416. In one or more embodiments, each of the insulated sections 604 are separated from one another other by a plurality of gaps 608 that are positioned between ends 520 of one or more adjacent insulated sections 604. In various embodiments, a gap 608 separates each of the adjacent insulated sections 604 and exposes portions of the conductors 504 of the pair of parallel wires 458. A gap 608 is formed by removing portions of insulation so as to expose conductors 504, or by otherwise axially shifting portions of insulation to expose conductors 504. In an embodiment, and as depicted in FIGS. 6B and 6C, axially-extending portions of conductors 504 are devoid of portions of the wire insulation entirely about a circumference of each of the conductors 504 (contrast to FIG. 6A wherein only a portion of insulation is removed to expose a conductor portion 504*a*). In various embodiments at least one of a plurality of LEDs 424 is disposed between ends 520 of each of the insulated sections 604 to electrically bridge the pair of parallel wires 428 and its conductors 504. As described, a translucent material 516 is disposed the gaps 608 to encapsulate the LEDs 424 and the exposed portions of the pair of parallel wires 428, i.e., conductors 504.

In various embodiments, the LEDs 424 are oriented so that the light emitted by the LED 424 is initially emitted in a direction substantially parallel to the parallel wires 428 of the light string 404-416. That is, the LED 424 effectively irradiates an end 520 of the insulated section 604 that is exposed for connection of the LED 424 to the parallel wires 458. The LED 424 may be connected to conductors 504 of the parallel wires 458 using techniques described above or otherwise available to the artisan. The LED 424, exposed portions of the parallel wires 458, i.e., conductors 504, and exposed ends of the electrical insulation 508 are then encapsulated, for example in the epoxy or other translucent, transmissive or similar material 516. In some embodiments, the material 516 may define voids 524.

In operation, the LED 424 oriented as depicted in FIGS. 6A-6C will, in various embodiments, distribute the light emitted by the LED 424 in a direction 525 along a longitudinal axis 526 of the light strings 404-416. In various embodiments, the encapsulation material 516 helps to diffuse, scatter, and refract the emitted light away from the longitudinal axis 526. In various embodiments, the voids 524 can also enhance the diffusion, scattering, and refraction of light away from the longitudinal axis 526 of the light string 404-416. Functionally, the arrangement of FIGS. 6A-6C will tend to make the lighting effect of the lighting strings 404-416 more uniform, particularly when oriented as a part of a shaped or shapeable light string as described further below.

Figure 7A:
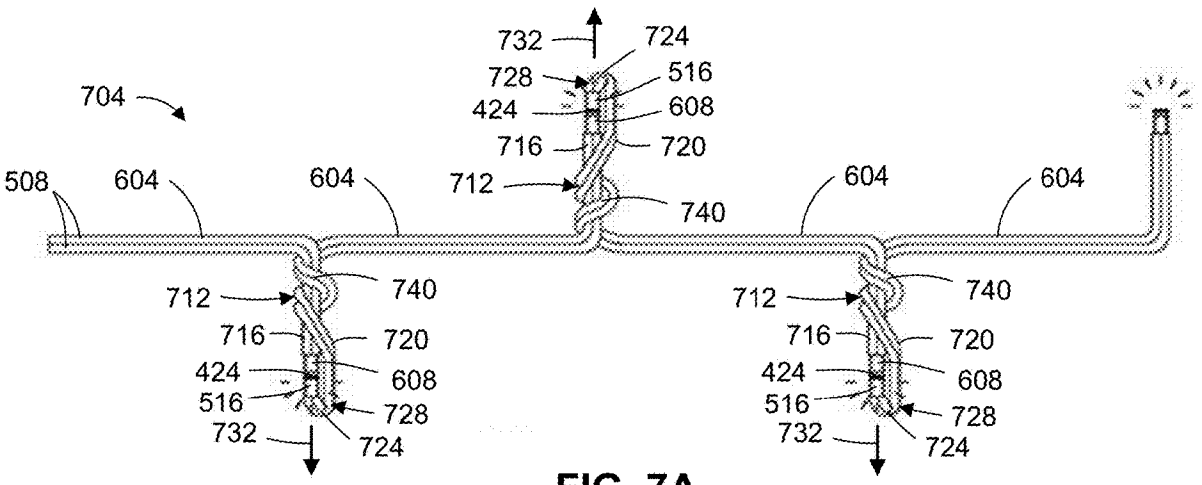
FIGS. 7A-7B depict a shaped LED light string, according to one or more embodiments of the disclosure.
Figure 7B:
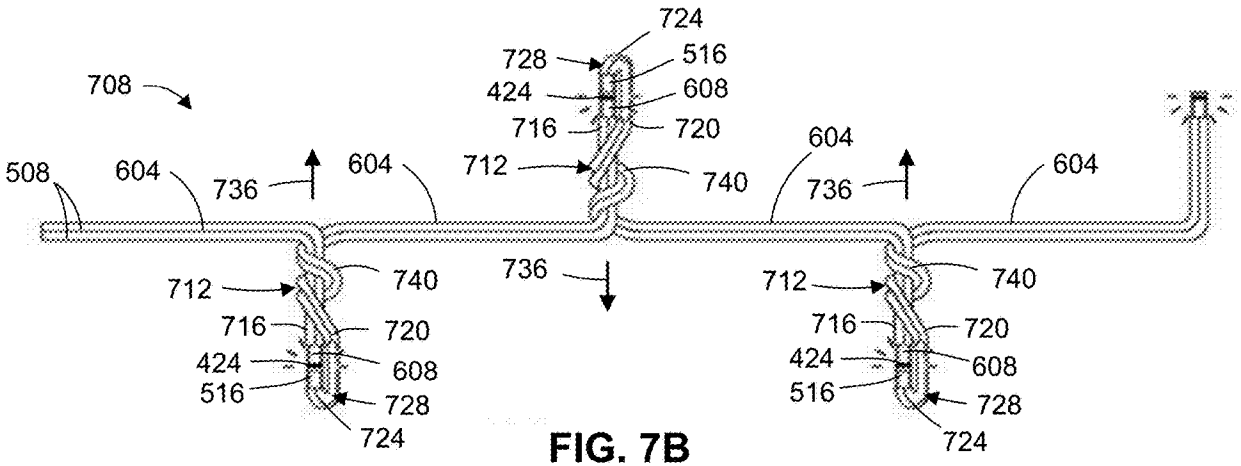

Referring to FIGS. 7A-7B shaped LED light strings 704, 708 are depicted, according to one or more embodiments. In various embodiments, shaped light strings 704, 708 are formed from one or more of light strings 404-416 as described above. As such, in various embodiments, shaped light strings 704 708 include the pair of parallel wires with an electrically insulative material 508 disposed over the pair of parallel wires. As described above, in various embodiments, the insulative material 508 defines a plurality of insulated sections 604. In one or more embodiments, each of the insulated sections 604 are separated from one another by the gaps 608 positioned between ends of adjacent insulated sections 604. As describe above, in various embodiments, LEDs 424 are disposed in the gaps 608 between ends of each of the insulated sections 604 to electrically bridge the pair of parallel wires, thereby connecting LEDs 424 to power. Translucent material 516 is disposed in each of the plurality of gaps 608 and encapsulating each of the plurality of LEDs 424 and the exposed portions of the pair of parallel wires.

Depicted in FIGS. 7A-7B, the light string 704, 708 is shaped to define a plurality of lighting sections 712. In various embodiments each of the plurality of lighting sections 712 extend between first and second portions 716, 720 of adjacent insulated sections 604 and include an LED 424 and the translucent material 516 disposed in the gap 608 between the portions 716, 720 of the insulation sections 604. In certain embodiments, the lighting sections 712 are separated by a main portion 722 of the light string 704, 708 that extends along the longitudinal axis of the light string 704, 708.

In one or more embodiments, each of the lighting sections 712 is shaped via a bend 724 in one of the portions 716, 720 of the adjacent insulation sections 604. As a result of the bend 724, in one or more embodiments, the portions 716, 720 are at least partially folded together to define a first end portion 728 of the lighting section 712 that includes the LED 424, the translucent material 516, and the bend 724. As a result, in various embodiments, the LED 424 is oriented to either direct the maximum intensity of light in a direction 732, towards the bend 724 (e.g. depicted in FIG. 7A), or in a direction 736, away from the bend 724 (depicted in FIG. 7B).

In certain embodiments, the portions 716, 720 of adjacent insulated sections 604 are coupled or fastened together to keep the portions 716, 720 of the adjacent insulated sections 604 at least partially folded together. As such, in some embodiments, the portions 716, 720 are not twisted together, but instead are held together by a coupler or fastener such as, for example, a zip tie (cable tie), a clip, elastic band, adhesive or other device suitable for attaching the two portions 716, 720 of the adjacent insulated sections 604 together. For example, in certain embodiments, the portions 716, 720 and the bend 724 define a substantially U-shaped lighting section 712, or lighting section with a U-shaped bend at an end, with each of the portions 716, 720 extending together in an approximately straight line to the bend 724.

In one or more embodiments, the portions 716, 720 of adjacent insulated sections 604 are twisted together via a twisted section 740 to keep the portions 716, 720 of the adjacent insulated sections 604 at least partially folded together. As such, in one or more embodiments, the twisted sections 740 maintain the shape of the lighting sections 712 in the light strings 704, 708 without the use of a coupler or fastener as described above. However, in certain embodiments, the twisted sections 740 can additional include a coupler or fastener, as described above, to further secure the adjacent insulated sections at least partially folded together and the shape of the lighting sections 712.

In various embodiments, such as depicted in FIG. 7B, with light emitted away from the bend 724, the twisted section 740 can further diffract, deflect, or otherwise affect the light emitted from the LEDs, as compared to 424 a lighting section 712 having a substantially U-shaped bend or lighting section 712. As such in certain embodiments, the twisted section 740 can result in additional decorative effects, which includes effectively aiming the LEDs as desired.

In various embodiments, the lighting sections 712 form flexible portions of the light string 704, 708 that can be readily adjusted or controlled by a user to direct emitted light from one or more of the LEDs 424 of the light strings 704, 408. For example, in various embodiments the parallel wires 458 are of a gauge, for example in a range of 24 AWG to 30 AWG. In some embodiments, a smaller gauge wire, particularly a single-conductor wire, will allows the light string to be flexibly bended, twisted, or otherwise shaped, while also having sufficient rigidity to substantially maintain its form after being shaped.

In certain embodiments, described further below, the light strings 704, 708 can be distributed among branches in an artificial tree. In various embodiments, each of the lighting sections 712 allow for a user to control flex or shape the light strings 704, 708 to control the direction/orientation of light emitted from the LEDs 424 such that they emit light in a manner that is controllable by a user.

Figure 8A:
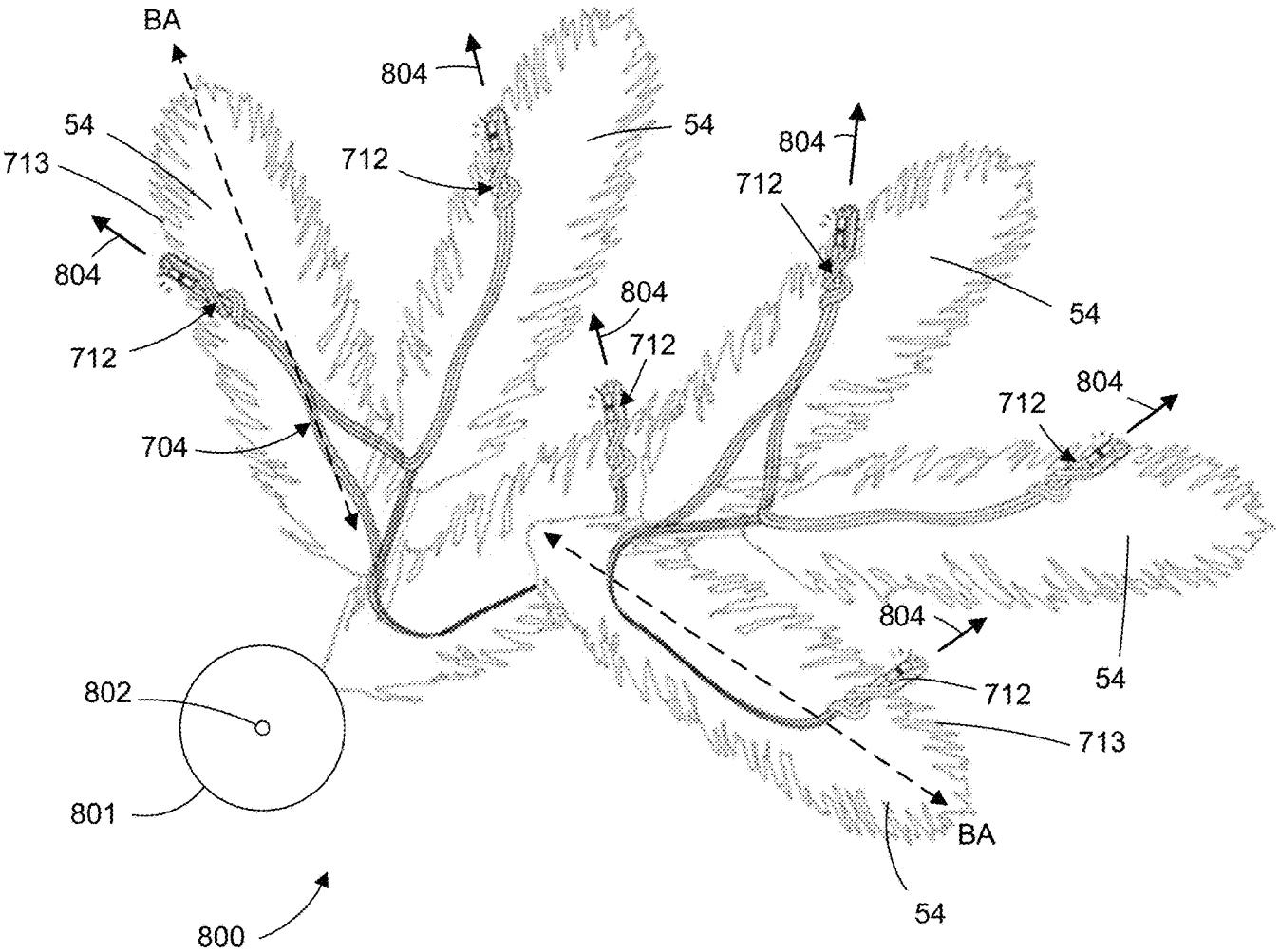
FIGS. 8A-8B depict a cross-sectional view of an artificial tree including a shaped LED light string, according to one or more embodiments of the disclosure.
Figure 8B:
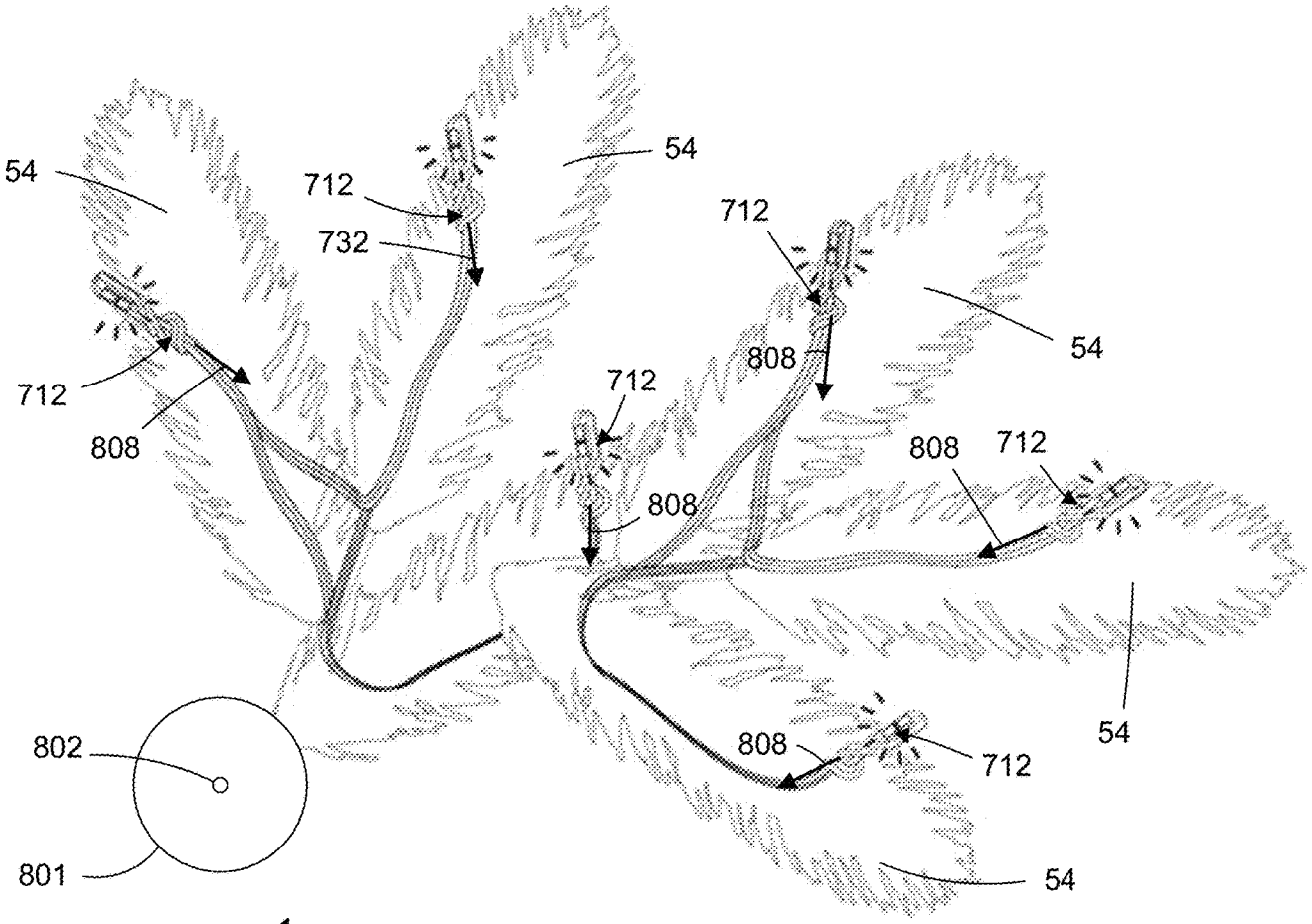

Referring to FIGS. 8A-8B, a top down cross section of a pre-lit decoration having a shaped LED light string 704, 708 is depicted, according to one or more embodiments of the disclosure. In various embodiments, light string 704, 708 is substantially the same as depicted in FIGS. 7A-7B. As such, light string 704, 708, includes a plurality of shaped lighting sections 712 including an LED. Depicted in FIGS. 8A-8B, each of the lighting segments are distributed among branches 54 of an artificial tree 800 having a trunk portion 801 and a central axis 802. As a result of the lighting sections 712, LEDs can be oriented in specific directions to achieve a desired decorative look for the artificial tree 800. For example, depicted in FIG. 8A, each of the lighting sections 712 are oriented such that the LEDs emit light in a direction 804, such as outwardly from the trunk portion 801 and the central axis 802. Depicted in FIG. 8B, in certain embodiments, each of the lighting sections 712 are oriented such that the LEDs emit light in a direction 808, inwardly towards the trunk portion 801 and the central axis 802.

As also depicted lighting sections 712 are distributed on branches 54 or sub-branches 118 such that each end of a light section 712, or bend in the light string, is positioned to extend beyond the needles 713 of the branches 54 or sub-branches 118 such that LEDs 424 are more readily viewable and not covered or obstructed by the needles 713. In an embodiment, substantially all lighting sections 712, or in another embodiment, a majority of lighting sections 712, are positioned on branches such that LEDs 424 extend radially further from a branch rod or axially-extending framework or spine or central portion of a branch or sub-branch, along a central branch axis BA, as compared to a needle 713, such that the needles 713 do not cover LEDs 424. This contrasts to known configurations wherein conventional light strings are simply randomly wrapped about branches, often leaving lights covered or obstructed from view.

In some light string embodiments 404, etc., depicted herein, LEDs 424 emit light axially along the wires of the light string, and in directions 804, or 808 as depicted, it will be understood that in other embodiments having light strings 404, etc., that include LEDs 424 that emit light in a radial direction from the wires of the light strings, i.e., with LEDs 424 rotated 90 degrees as compared to LEDs 424 of light strings 404, etc., lighting sections 712 may still extend beyond needles 713, but may emit light in directions transverse to either of 804 or 808 due to the different orientation of the LED with respect to the light string wiring.

Figure 9A:
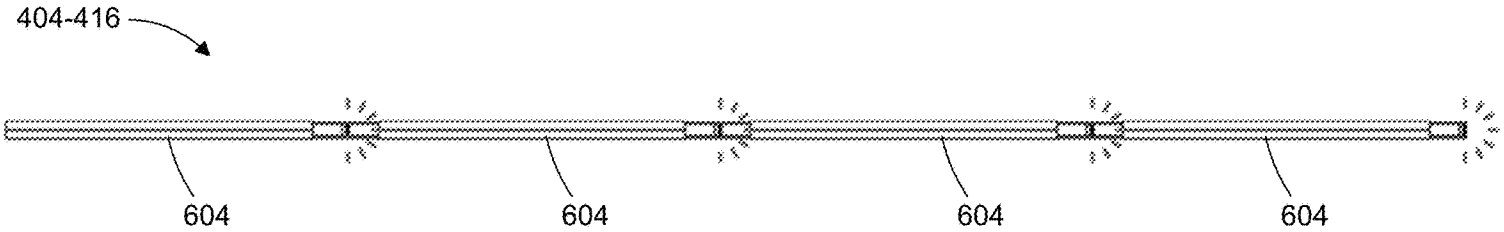
FIG. 9A-9B depicts a process of shaping an LED light string, according to one or more embodiments of the disclosure.
Figure 9B:
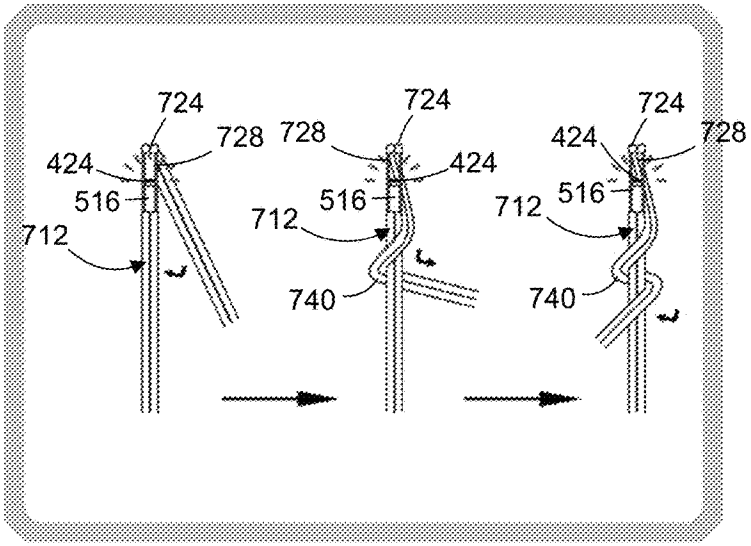

Referring to FIGS. 9A-9B, a method of shaping a light string 404-416 is depicted, according to one or more embodiments of the disclosure. In one or more embodiments, the method includes obtaining a light string 404-416. In various embodiments, obtaining a light string 404-416 includes obtaining an LED light string as described above with regard to FIGS. 6A-6C. In certain embodiments, the method includes forming, using the light string 404-416, a plurality of lighting sections 712. In various embodiments, forming a lighting section 712 includes forming via a bend 724 in a portion of adjacent insulation sections 604 such that portions of the adjacent insulation sections 604 are at least partially folded together to define a first end portion 728 of the lighting section 712 including an LED 424, a translucent material 516, and the bend 724.

In various embodiments the method includes forming a twisted portion 740 in the lighting section 712. In certain embodiments, the twisted portion 740 is formed by wrapping one of the portions of insulated sections about one other to maintain the insulated sections 640 folded together. Alternatively, in certain embodiments, the insulated sections 640 can be coupled or fastened together to maintain the insulated sections folded together.

Additional discussion of LED-based lighting and light strings is included in U.S. Provisional Application 62/466,547 to Chen, entitled "Refractive Decorative Lighting String", incorporated herein by reference in its entirety and included herein as Appendix A.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. An artificial tree comprising:

a tree trunk defining a central axis;

a plurality of branches extending radially outwardly from the tree trunk, each of the plurality of branches including a plurality of sub-branches, each of the sub-branches including a plurality of artificial tree needles extending outwardly from a portion of the sub-branch;

a main power circuit for transmitting electrical power;

a shaped light string in electrical connection with the main power circuit, including:

a pair of insulated parallel wires defining a longitudinal axis that extends parallel to and between the pair of parallel wires, each of the parallel wires including a conductor and an electrically-insulative material disposed over the conductor;

a plurality of light emitting diode (LED) assemblies electrically connected to the conductors of the pair of parallel wires, the LED assemblies being oriented to direct a maximum intensity of light emitted from the LED assemblies in a first direction; and wherein the shaped light string is shaped to define a plurality of lighting sections, each of the plurality of lighting sections extending from a main portion of the shaped light string that extends between pairs of lighting sections, and including a first longitudinally-extending portion of the parallel wires, a second longitudinally-extending portion of the parallel wires, the second longitudinally-extending portion of the parallel wires being adjacent to, and in contact with the first longitudinally-extending portion of the parallel wires, an LED assembly of the plurality of LED assemblies, the LED assembly adjacent the first longitudinally-extending portion of the parallel wires and the second longitudinally-extending portion of the parallel wires, and a bend in the first longitudinally-extending portion of the parallel wires, the bend forming an end portion of the lighting section; and wherein the shaped light string is distributed about the plurality of branches and sub-branches.

2. The artificial tree of claim 1, wherein each end of each of the lighting sections includes an LED assembly of the plurality of LED assemblies.

3. The artificial tree of claim 2, wherein each of the plurality of lighting sections extends outwardly from a portion of the sub-branch further than adjacent needles of the sub-branch, such that a view of each LED assembly is unobstructed by the adjacent needles of the sub-branch.

4. The artificial tree of claim 3, wherein each of the plurality of LED assemblies is oriented to direct a maximum intensity of light emitted from the LED assemblies in a direction substantially parallel to the longitudinal axis.

5. The artificial tree of claim 1, wherein each of the plurality of LED assemblies is oriented to direct a maximum intensity of light emitted from the LED assemblies in a direction substantially parallel to the longitudinal axis.

6. The artificial tree of claim 5, wherein the direction substantially parallel to the longitudinal axis is in a direction substantially away from the trunk.

7. The artificial tree of claim 1, wherein each of the conductors is a continuous, uninterrupted conductor.

8. The artificial tree of claim 1, wherein the electrically-insulative material of the shaped light string comprises multiple insulative sections, each of the insulative sections separated from one another so as to not be in contact with one another, adjacent pairs of insulative sections forming gaps between adjacent insulative sections, and each LED assembly being located in a gap formed by an adjacent pair of insulative sections.

9. The artificial tree of claim 8, wherein the LED assembly comprises an LED chip and a base portion having a first electrical contact and a second electrical contact, the first electrical contact being on a first side of the base, the second electrical contact being on a second side of the base, the LED chip being on a top side of the base, and the first and second electrical contacts are in electrical connection with the conductors of the light string at the first and second sides of the base.

10. The artificial tree of claim 1, further comprising a translucent material encapsulating the LED assembly and covering portions of the electrically-insulative material of the pair of insulated parallel wires.

11. The artificial tree of claim 1, wherein the first portion of the pair of insulated parallel wires is mechanically coupled to the second portion of the pair of insulated parallel wires.

12. The artificial tree of claim 11, wherein the first portion of the pair of insulated parallel wires is mechanically coupled to the second portion of the pair of insulated parallel wires by twisting the first portion with the second portion, or by joining the first portion and the second portion with a mechanical fastener.

13. The artificial tree of claim 1, wherein at least one of the plurality of LED assemblies includes multiple LED chips.

14. The artificial tree of claim 13, wherein the multiple LED chips comprise LED chips that emit light of the same color.

15. The artificial tree of claim 13, wherein the multiple LED chips comprise LED chips that emit light of different colors.

16. The artificial tree of claim 1, wherein each of the plurality of LED assemblies includes a controller.

17. An artificial tree comprising:

a first tree section defining a first central axis, including:

a first tree trunk portion;

a first plurality of branches extending radially outwardly from the first tree trunk portion;

a first shaped light string distributed about the first plurality of branches, the first shaped light string comprising a first pair of insulated parallel wires and a first plurality of light-emitting diode (LED) assemblies electrically connected in parallel to the first pair of parallel wires, the first shaped light string forming a first plurality of lighting sections, each of the first plurality of lighting sections including a portion of the pair of insulated parallel wires that forms a bend in the wires at a location adjacent to one of the plurality of LED assemblies such that a first portion of the first shaped light string is adjacent to, and in contact with, a second portion of the first shaped light string, the first portion of the first shaped light string being mechanically coupled to the second portion of the first shaped light string;

a first power circuit for transmitting electrical power, the first power circuit in electrical connection with the first shaped light string; and a second tree section defining a second central axis, including:

a second tree trunk portion;

a second plurality of branches extending radially outwardly from the second tree trunk portion;

a second shaped light string distributed about the first plurality of branches, the second shaped light string comprising a second pair of insulated parallel wires and a second plurality of light-emitting diode (LED) assemblies electrically connected in parallel to the second pair of parallel wires, the second shaped light string forming a second plurality of lighting sections, each of the second plurality of lighting sections including a portion of the pair of insulated parallel wires that forms a bend in the second wires at a location adjacent to one of the second plurality of LED assemblies such that a first portion of the second shaped light string is adjacent to, and in contact with, a second portion of the second shaped light string, the first portion of the second shaped light string being mechanically coupled to the second portion of the second shaped light string;

a second power circuit for transmitting electrical power, the second power circuit connectable to the first power circuit, and in electrical connection with the second shaped light string.

18. The artificial tree of claim 17, wherein the first power circuit and the second power circuit each comprise an electrical connector that is at least partially inside the first and second tree trunks, respectively.

19. The artificial tree of claim 17, wherein the first tree section is configured to couple to the second tree portion in multiple rotational alignments about the first and second central axes.

20. The artificial tree of claim 17, wherein each of LED assemblies of the first plurality of LED assemblies are electrically connected to one another in parallel.

21. The artificial tree of claim 17, wherein some of the LED assemblies of the first plurality of LED assemblies are electrically connected to one another in parallel, and other LED assemblies of the first plurality of LED assemblies are electrically connected to one another in series.

22. The artificial tree of claim 17, wherein each of the first plurality of lighting sections extends outwardly from a portion of the branch further than adjacent needles of the branch, such that a view of each of the first LED assemblies is unobstructed by the adjacent needles of the branch.

23. The artificial tree of claim 17, wherein each of the plurality of LED assemblies is oriented to direct a maximum intensity of light emitted from the LED assemblies in a direction substantially parallel to the longitudinal axis.

24. The artificial tree of claim 17, wherein at least one of the plurality of LED assemblies includes multiple LED chips.

25. The artificial tree of claim 17, wherein each of the plurality of LED assemblies includes a controller.

26. An artificial tree comprising:

a tree trunk having a central axis and a plurality of branches extending radially outwardly from the tree trunk and the central axis;

a plurality of shaped light strings, each of the plurality of shaped light strings in electrical connection with a main power circuit for transmitting electrical power to the plurality of shaped light strings, each of the plurality of shaped light strings including:

a pair of parallel wires defining a longitudinal axis that extends parallel to and between the pair of parallel wires, each of the parallel wires including a conductor and an electrically insulative-material disposed over the conductor;

a plurality of light emitting diode (LED) assemblies electrically connected to the pair of parallel wires, the LED assemblies being oriented to direct a maximum intensity of light emitted from the LED assemblies in a direction substantially parallel to the longitudinal axis; and wherein each of the shaped light strings are shaped to define a plurality of lighting sections, each of the plurality of lighting sections including a first portion of the pair of parallel wires, a second portion of the pair of parallel wires, the second portion of the pair of parallel wires being adjacent to the first portion of the pair of parallel wires, an LED assembly of the plurality of LED assemblies, the LED assembly located between the first portion of the pair of parallel wires and the second portion of the pair of parallel wires, and a wire bend in portions of adjacent sections of the electrically-insulative material of the pair of parallel wires such that the first and second portions of the pair of parallel wires are at least partially folded together to define a first end portion of the lighting section including the LED assembly, and the wire bend; and wherein the plurality of shaped light strings are distributed about the plurality of branches.

27. The artificial tree of claim 26, wherein the tree trunk includes a plurality of detachable sections.

28. The artificial tree of claim 26, wherein each LED assembly of each lighting section is oriented to direct the maximum intensity of light emitted from the LED assemblies of each lighting section in a direction radially inwardly relative to the central axis of the tree.

29. The artificial tree of claim 26, wherein each LED assembly of each lighting section is oriented to direct the maximum intensity of light emitted from the LED assemblies of each lighting section in a direction radially outwardly relative to the central axis of the tree.

30. The artificial tree of claim 26, wherein a first portion of the LED assemblies of the plurality of lighting sections are oriented to direct the maximum intensity of light emitted from the first portion of LED assemblies in a direction radially inwardly relative to the central axis of the tree, and a second portion of the LED assemblies of the plurality of lighting sections are oriented to direct the maximum intensity of light emitted from the second portion of the LEDs in a direction radially outwardly relative to the central axis of the tree.

31. The artificial tree of claim 26, wherein the main power circuit is disposed at least partially within the tree trunk.

32. The artificial tree of claim 26, wherein the insulated material defines a plurality of insulated sections along the longitudinal axis, each of the plurality of insulated sections being separated from one another along the longitudinal axis by a plurality of gaps positioned between ends of one or more adjacent insulated sections of the plurality of insulated sections, each of the plurality of gaps exposing portions of the conductors of the pair of parallel wires.

* * * * *